United States Patent [19]

Brady

[11] 3,970,396

[45] July 20, 1976

[54] PAINT APPLICATOR

[76] Inventor: William J. Brady, 549 Riverside Drive, New York, N.Y. 10027

[22] Filed: June 18, 1975

[21] Appl. No.: 588,014

[52] U.S. Cl. ..... 401/208; 15/230.11
[51] Int. Cl.[2] ..... B44D 3/28
[58] Field of Search ..... 401/208, 216, 197, 28.35, 401/9; 15/230.11

[56] References Cited

UNITED STATES PATENTS

| | | | |
|---|---|---|---|
| 2,538,241 | 1/1951 | Guimond | 15/230.11 |
| 2,988,769 | 6/1961 | Panfil | 401/208 X |
| 3,008,167 | 11/1961 | Pharris et al. | 15/230.11 |
| 3,336,625 | 8/1967 | Carlee | 401/197 |
| 3,714,674 | 2/1973 | Simoncioni | 15/230.11 |

*Primary Examiner*—Lawrence Charles
*Attorney, Agent, or Firm*—Frank Ledermann

[57] ABSTRACT

This invention is a paint applicator comprising a pair of hollow cylindrically shaped relatively rigid paint roller segments, slightly spaced apart and axially arranged along a shaft extended therethrough, and having resilient mounting means to accept a handle holding structure thereby enabling the paint roller segments to be rolled across a work surface and adjust themselves with a slight pressure applied on the handle without stopping the rolling action of the paint roller segments when the applicator is being used for painting the underside or bottom of a structural member having a bisecting center line defined by the intersection of two common work surfaces. An alternate form of the paint applicator includes a paint container in the form of an open trough with a supporting handle pivotally attached to the container that the container will be always positioned horizontally to prevent paint from spilling therefrom, and a paint applying roller assembly of the character above described, rotatably mounted in the paint container having a portion thereof partially in the paint while an opposite portion is partially above the top of the open trough from which paint may be applied to a work surface.

2 Claims, 7 Drawing Figures

FIG. 1
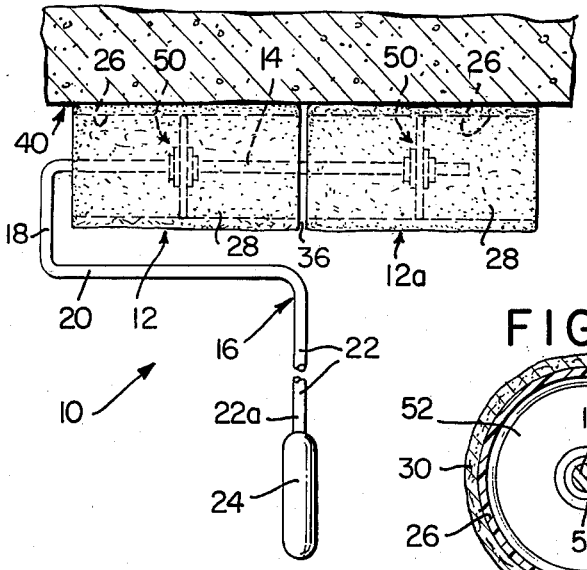
FIG. 2
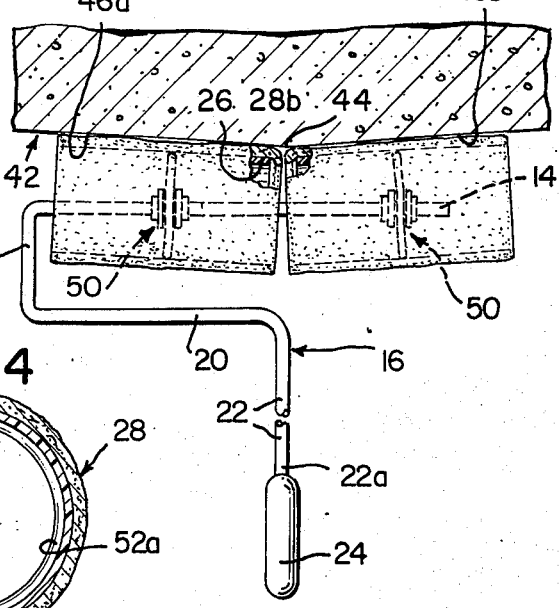
FIG. 4
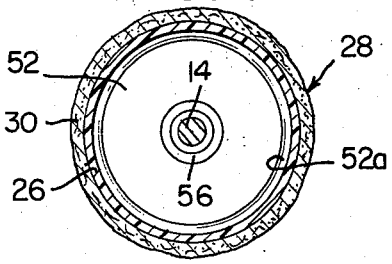
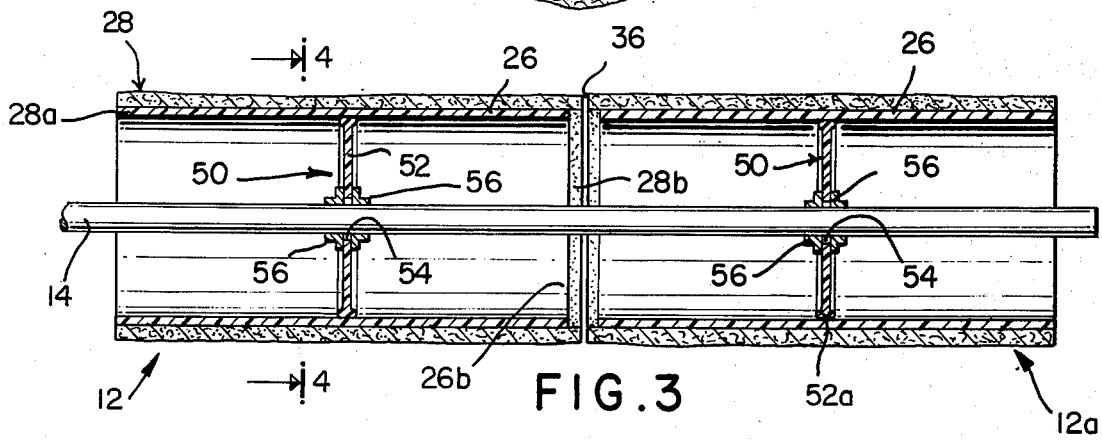
FIG. 3
FIG. 5
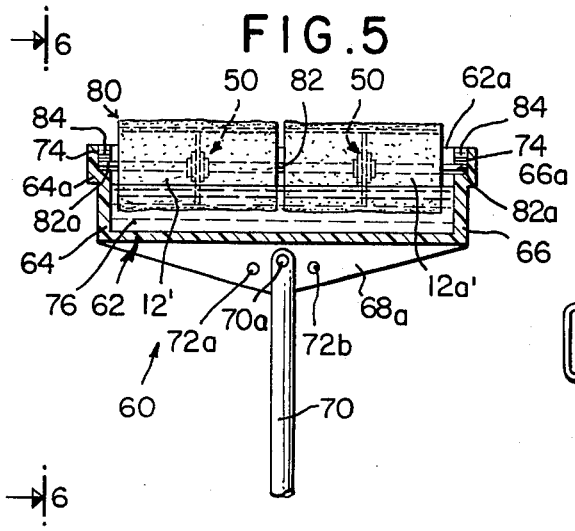
FIG. 7
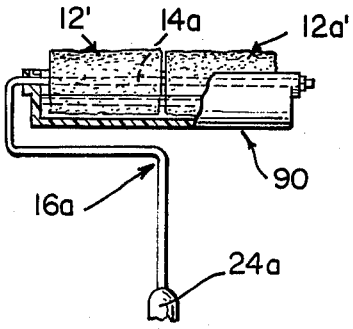
FIG. 6
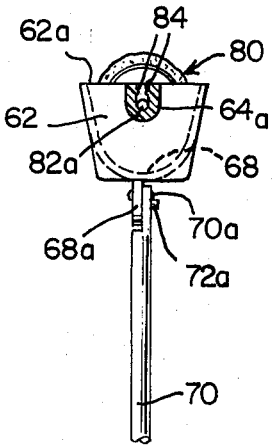

PAINT APPLICATOR

BACKGROUND OF THE INVENTION

1. Field of the Invention

This invention relates to paint applicators and more particularly to special purpose rollers for applying paint or similar such substances to flat work surfaces or to surfaces having a longitudinal bisecting center line defined by the intersection of two common surfaces.

2. Description of the Prior Art

An important part of the painter's work is the painting of structural members which project below the ceiling or false beams formed to conceal pipes, air conditioning ducts, etc., particularly found in large buildings such as schools, industrial plants, hospitals and warehouses. The use of conventional roller type applicators for applying paint to various work surfaces is well known. Such paint applicators generally include an elongated cylindrical roll having an absorbent sleeve rotatably mounted on a shaft including a handle portion. These types of paint applicators are particularly useful when painting flat coplanar work surfaces.

However, when it is necessary to paint the underside of a great number of beams, particularly those which include longitudinal intersecting common surfaces, the use of conventional paint applicators has become a time consuming operation because additional paint rolling strokes are necessary to apply separately to each one of the intersecting surfaces of the underside of the beam.

Examples of known paint applicators are illustrated in U.S. Pat. Nos. 3,588,264; 3,712,748 and 3,702,739. However, none of these patents shows or suggests the novel features of the paint applicator of the present invention.

SUMMARY OF THE INVENTION

Accordingly, it is the primary object of the present invention to provide a roller type paint applicator having a pair of hollow paint roller segments axially arranged along a shaft extended therethrough. The paint roller segments are adjacently and rotatably mounted on the common shaft through resilient mounting means provided within the hollow roller segments. The construction of the resilient mounting means permits the paint roller segments to adjust themselves to the work surface of the character described with just a slight pressure without stopping the rolling action of the paint roller segments.

It is another object of the present invention to provide a paint applicator comprising a trough having an open top and a paint reservoir at the bottom, a supporting handle pivotally attached to the container and a paint roller assembly with axially arranged adjacent paint roller segments rotatably mounted in the trough having at least a portion of the roller segments partly in the reservoir and another portion at least partly outside of the top of the trough.

A further object of this invention is to provide two sections of interconnected paint roller segments having an elongated shaft extended therethrough and providing free journal end portions at each side of the roller segments.

It is another object of the invention to provide a paint applicator of the character described which is of simple construction, has a minimum number of parts, is inexpensive to manufacture and efficient in operation and use.

The foregoing and other objects and advantages of this invention will be clear to those skilled in the art upon reading the detailed description of a preferred embodiment which follows in conjunction with the attached drawings.

BRIEF DESCRIPTION OF THE DRAWINGS

FIG. 1 is a side elevational view of a preferred embodiment of the present invention in operative use upon the underside of a structural member having a flat work surface;

FIG. 2 is a similar view to FIG. 1 but showing the paint applicator in operative use upon the underside of a structural member having a bisecting center line defined by two intersecting common surfaces;

FIG. 3 represents a longitudinal cross sectional view of the paint applicator illustrated in FIG. 1;

FIG. 4 shows a sectional view taken along the line 4—4 of FIG. 3;

FIG. 5 is a side elevational view of a different embodiment of the present invention, showing the paint reservoir broken away to show details of construction;

FIG. 6 illustrates a lateral side view of FIG. 5, and;

FIG. 7 shows a side elevational view of an alternated embodiment.

DESCRIPTION OF A PREFERRED EMBODIMENT

Referring now to the drawings, FIG. 1 illustrates a paint applicator constructed in accordance with the present invention designated generally at 10, which comprises a pair of paint roller segments **12–12*a* axially arranged along a shaft portion 14 of a supporting structure 16**.

The supporting structure 16 also includes a relatively short integral bent portion 18, an integral bent portion 20 parallel to the shaft portion 14 and an angularly bent shank portion 22 normal to the portion 20. Secured to the other end **22*a* of the shank portion 22 is a handle 24. The length of the shank portion 22** and the handle are proportionated to provide a comfortable normal use of the paint applicator.

As can be seen in FIG. 3 each paint roller segment **12–12*a* includes a hollow tubular member 26 forming the structural core of the roller segment. The tubular member 26** may be constructed of cardboard or may be of any other suitable material.

The tubular member or core 26 is surrounded by a sleeve 28 made of an absorbent material such as felt, flocking or other suitable applicating material, having one end **28*a* flush with the corresponding end of the tubular member 26, while the other end 28*b* of the sleeve 28 slightly extends over the end 26*b* of the tubular member. The purpose of the end 28*b* of the sleeve 28 extending beyond the end of the tubular member 26** will be explained subsequently with the operation of the paint applicator.

Resilient means 50 are provided for adjusting the relative position of the paint roller segments **12–12*a* to the contour of the work surface to be painted and include a relatively thin disc 52 disposed substantially at the center of the tubular member 26 and normal thereto, fitting within the hollow tubular member in fixed relation thereto to provide for rotation of the paint roller segments 12–12*a* on the shaft portion 14. The disc 52 may be constructed of any number of resilient materials such as rubber or plastic, and includes a peripheral rib 52***a* and a central opening 54 to receive the shaft portion 14 extending therethrough. To prevent the axial movement of the paint roller segments 12–12*a* along the shaft portion 14, the resilient means are provided with retainer washers 56 fixedly secured respectively to the shaft portion 14 whereby the paint roller segments 12–12*a* are axially mounted on the shaft portion 14 in a slightly spaced relation. It will be noted that with this type of arrangement, the paint roller segments 12–12*a* are axially arranged on the shaft portion 14 in such a way that the ends 28*a* of the paint roller segments define a gap 36 or small space therebetween. The distance between the paint roller segments is selected so that the paint applicator of the present invention may be used satisfactorily either for painting flat work surfaces such as indicated at 40 in FIG. 1 or for painting work surfaces 42 having a bisecting center line 44 defined by the intersection of two common surfaces 46 *a–46b* such as shown in FIG. 2.

It will be apparent that the construction described provides a versatile paint applicator that regardless of how the roller segments pivot around the disc 52 when painting the underside of a structural member having the work surface 42, the roller segments 12–12*a* will continue to rotate with hardly any effort and in one easy painting rolling stroke do a surface that would take repeated strokes with a conventional straight paint roller.

The paint applicator shown in FIG. 5 is a modified embodiment of the present invention and designated generally at 60. The applicator comprises a paint container 62 in the form of a trough having an open top 62*a*. The container, which may be formed from a thermoplastic material, includes opposite facing end walls and may be of any suitable shape, preferably having a circular bottom 68, FIG. 6. A handle 70 of a convenient shape and length is fixedly pivoted at 70*a* to a downward projection 68*a* of the container or reservoir 62. A pair of projecting stop members 72*a–72b* are arranged adjacent pivot point 70*a* to limit the angular movement of the handle 70. Each end wall 64–66 includes a thickened wall portion 64*a–66a* having opposite vertical slots 74 on their facing inner wall surfaces extending downward thereinto.

The paint applying roller assembly 80 comprises a pair of paint roller segments 12′–12*a′* axially spaced in a close relationship on a spindle or axle 82 which extends longitudinally therethrough, and having hub portions 82*a* at their opposite ends. The structural features and the mounting arrangement of the roller segments 12′–12*a′* are similar to the paint roller segments described above in connection with FIG. 1–4. As illustrated in detail in FIG. 5, the paint applying roller assembly 80 is rotatably supported between the vertical slots 74 through the hub portions 82*a* so that a portion of the roller segments 12′–12*a′* is partially in the paint 76 while an opposite portion thereof is partially outside the open top 62*a* of the container 62. The upper inner wall portions of the vertical slots 74 include facing protuberances or similar retainer means 84 to prevent axle 82 to fall over from the open container 62.

The device shown in FIG. 7 represents another embodiment of the present invention which is essentially the same in principle as that above described. It will be noted that a shaft portion 14*a* of the supporting structure 16*a* passes through the side walls of an open container 90 having aligned journal slots. Due to this construction no matter at what angle the handle 24*a* is held with respect to the horizontal, the container 90 will maintain a horizontal position.

It is to be noted that the paint applying roller assembly 80 is readily removed from the container 62 for cleaning purposes by lifting the shaft 82 up from the slots 74 as seen in FIG. 5 or by removing shaft 14*a* from the journal slots of the container 90 as seen in FIG. 7.

It will be noted that regardless of the work surface to be painted the paint roller segments adjust themselves to the contour thereof with just a slight pressure on the handle during the rolling painting stroke due to the novel resilient mounting means provided, particularly when painting the underside or bottom of a structural member having a work surface such as indicated by the reference numeral 42 in FIG. 2. The inner edge 28*b* of the sleeve 28 will bend slightly inwardly whereby permitting the roller segments to pivot around the disc 52. When the pressure applied to the paint roller segments is removed, they return by themselves to their straight original position.

When using any of the paint applicators shown in FIGS. 5 and 7, paint 76 is poured into the container 62–90, either before or after the paint roller assembly is inserted within the slots 74.

While various changes may be made in the detail construction, it shall be understood that such changes shall be within the spirit and scope of the present invention as defined by the appended claims.

What is claimed is:

1. A device for applying paint to the undersides of two mutually adjacent substantially flat ceiling portions divided from each other by a straight line, comprising a container adapted to receive paint, said container having a bottom wall, side walls and end walls, a shaft supported between said end walls, applicator means for transferring paint from the bottom of said container to said ceiling portions, said applicator means comprising in part two identical cylindrical rollers of substantially larger diameter than said shaft surrounding said shaft and spaced a short distance from each other, each of said rollers having a thin and somewhat flexible plastic disc inside thereof and secured thereto intermediate the length of the roller, said discs having central openings therethrough of slightly larger diameter than said shaft, a pair of opposed retainer washers of slightly larger diameter than said central openings secured to said shaft inside each of said rollers and clamping said discs, said applicator means consisting additionally of absorbent coatings surrounding said rollers, and elongated handle means extending from said container.

2. A device according to claim 1, said absorbent coatings having the juxtaposed ends thereof extending beyond the corresponding end portions of said rollers, each of said juxtaposed end portions having a disc of absorbent material sealing said juxtaposed ends of said rollers.

* * * * *